US006178674B1

(12) United States Patent
Decaux et al.

(10) Patent No.: US 6,178,674 B1
(45) Date of Patent: Jan. 30, 2001

(54) DISPLAY PANEL

(76) Inventors: Jean-François Decaux, 72 Addison Road, W148EB London (GB); Jean-Charles Decaux, Plaza de Oriente, 8, 28013 Madrid (ES); Jean-Sébastien Decaux, 88 Boulevard Maurice Barrès, 92200 Neuilly-sur-Seine (FR)

( * ) Notice: Under 35 U.S.C. 154(b), the term of this patent shall be extended for 0 days.

(21) Appl. No.: 09/317,005

(22) Filed: May 24, 1999

(30) Foreign Application Priority Data

Apr. 30, 1999 (FR) ..... 99 05557

(51) Int. Cl.[7] ..... G09F 11/18
(52) U.S. Cl. ..... 40/471; 40/467; 40/518
(58) Field of Search ..... 40/466, 467, 471, 40/472, 518, 524, 448

(56) References Cited

U.S. PATENT DOCUMENTS

| | | | | |
|---|---|---|---|---|
| 4,005,535 | * | 2/1977 | Davis | 40/471 |
| 4,104,810 | * | 8/1978 | Mirman | 40/518 X |
| 4,333,255 | * | 6/1982 | Ward | 40/472 X |
| 4,680,883 | * | 7/1987 | Stadjuhar et al. | 40/471 |
| 5,946,836 | * | 9/1999 | Sahebolamri | 40/471 |

FOREIGN PATENT DOCUMENTS

| | | | |
|---|---|---|---|
| 2198321 | | 8/1998 | (CA) . |
| 297 03 805 | | 8/1997 | (DE) . |
| 0 267 453 | | 5/1988 | (EP) . |
| 2 659 161 | | 9/1991 | (FR) . |
| 92/18969 | * | 10/1992 | (WO) ..... 40/467 |
| WO 97/34283 | | 9/1997 | (WO) . |

OTHER PUBLICATIONS

French Preliminary Search Report dated Dec. 7, 1999, Int'l. Appl. No. FR 9905557.

* cited by examiner

*Primary Examiner*—Brian K. Green
(74) *Attorney, Agent, or Firm*—Marshall, O'Toole, Gerstein, Murray & Borun

(57) ABSTRACT

Display panel including several displays each having a surface area of at least 2 $m^2$ and an automatic display changing device adapted to show these displays successively to the public. Each display comprises an optically transparent window (7) which is placed in front of an image display device which displays successive images corresponding to the display shown to the public.

10 Claims, 2 Drawing Sheets

DISPLAY PANEL

FIELD OF THE INVENTION

This invention relates to display panels.

More particularly, the invention concerns a display panel comprising:

several displays all having the same format and each having a surface area of at least 2 $m^2$, at least one display surface visible to the public and allowing each display to be displayed, and an automatic display changing device adapted to show displays successively on the display surface to the public.

BACKGROUND OF THE INVENTION

Existing display panels of this type are well adapted to be visible from a distance in public places (public thoroughfares, airports, stations, shopping centres etc.) and to deliver very short advertising messages, limited for example to an image associated with a brand name and/or a slogan. However these display panels do not allow more detailed information of the corresponding product or service to be given.

OBJECTS AND SUMMARY OF THE INVENTION

This invention is particularly intended to compensate for this drawback.

To this end, according to the invention, a display panel of the said type is essentially characterised:

in that each display comprises in its surface an optically transparent window having a surface area between 5% and 70% of the surface area of the display, in that the display panel comprises at least one device for displaying images which includes a reserve of several images for each display of the display panel and which is adapted to display these images in the widow of each display (the said images may, if the need arises, be composed at least in part of text, and they may be still or animated), and in that the display panel moreover comprises control means adapted to display successively in the window of each display, by means of the image display device, the images corresponding to this display (in a predetermined order, or randomly, or yet according to the demands of the public if the display panel is made interactive).

These arrangements make it possible to give detailed information of the product or service displayed in large format on the display, this detailed information being visible to people approaching the panel after their attention has been drawn by the large format display and/or by the movement created by the succession of images displayed in the display window.

In preferred versions of the invention use may possibly be made moreover of one and/or other of the following arrangements:

the surface area of the window is between 10% and 40% or the surface area of the display, the window is substantially identical and situated in substantially the same place in the various displays, the image display device includes a screen situated to correspond with the place occupied by the window of each display when this display is shown on the display surface, the reserve images of the display device including at least one animated sequence, and the control means being adapted to display this animated sequence on the screen while the corresponding display is shown, the reserve images of the image display device include several animated sequences for each display, the control means being adapted to display these animated sequences on the screen while the corresponding display is shown, the control means are adapted to display different images from among the images corresponding to each display according to the time of day, the control means are connected to an interface allowing the public to choose the images displayed by the image display device from among the different images displayed on the display surface, the control means being adapted to then display these images by means of the image display device, the interface also allows the public to choose the display shown on the display surface, the control means being adapted to then show this display on the display surface by means of the display changing device, the displays are made up of successive portions of a flexible tape, the display changing device being adapted to run this flexible tape past the display surface in order to selectively show one of the displays on this display surface, the display panel comprises sound transmission means, the control means being adapted to transmit sounds corresponding to the images displayed by the image display device by means of these sound transmission means.

BRIEF DESCRIPTION OF THE DRAWINGS

Other characteristics and advantages of the invention will be revealed in the course of the following description of one of its versions, given as a non restrictive example, compared with the attached drawings.

In the drawings.

MORE DETAILED DESCRIPTION

In the various figures the same references correspond to identical or similar components.

Figure 1:
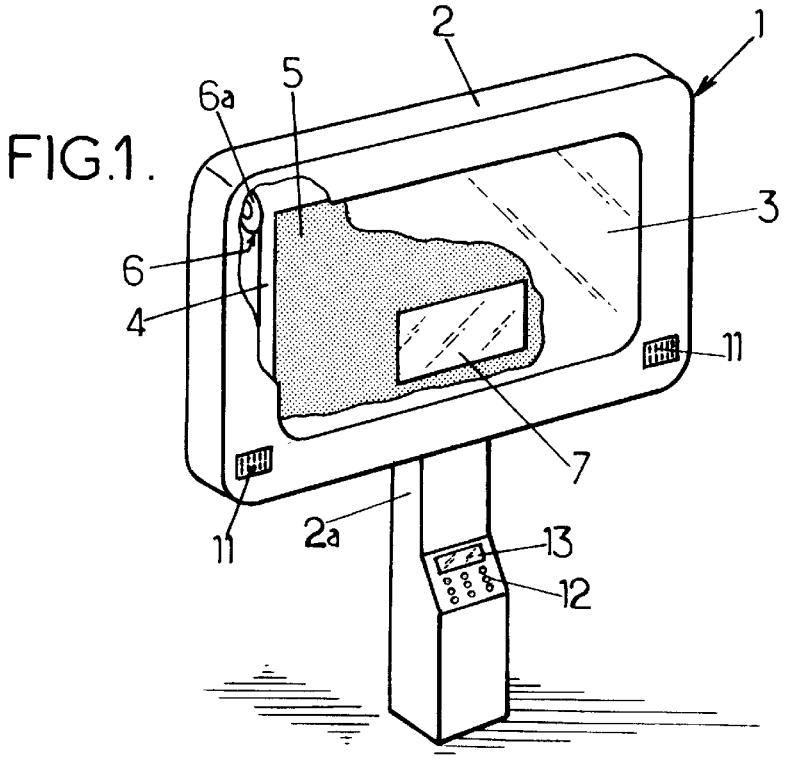
FIG. 1 is a perspective view of a display panel according to one version of the invention.
Figure 2:
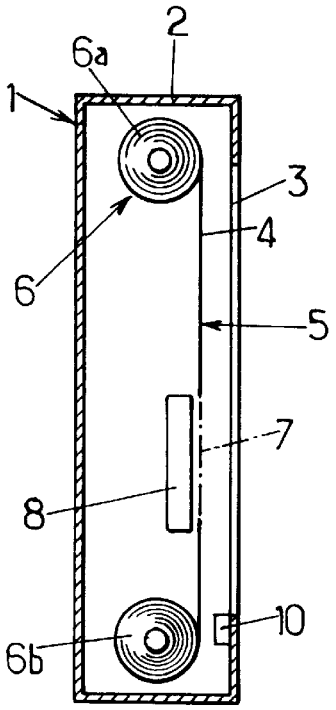
FIG. 2 is a schematic view in vertical section of the display panel shown in FIG. 1.

FIGS. 1 and 2 show a display panel 1 which is intended to be sited in a public place, for instance in a public thoroughfare, an airport, a station, a shopping centre etc.

This display panel comprises an outer closed case 2 which may rest on the ground, for example by means of a stand 2*a* and which has at least one main face provided with a glass panel 3 (this glass panel may if the need arises replaced by a simple recess).

The case 2 contains a flexible tape 4, made for example of paper, or of transparent or translucent synthetic film, on the length of which several advertising or general information displays are printed or otherwise fixed.

The tape 4 may be moved in a direction parallel to its length by a driving mechanism 6 which includes, for example, two reels 6*a* and 6*b* on which the said tape 4 is wound, this driving mechanism being adapted to selectively place one or other of the displays 5 on the tape 4 in front of the glass panel 3.

Figure 3:
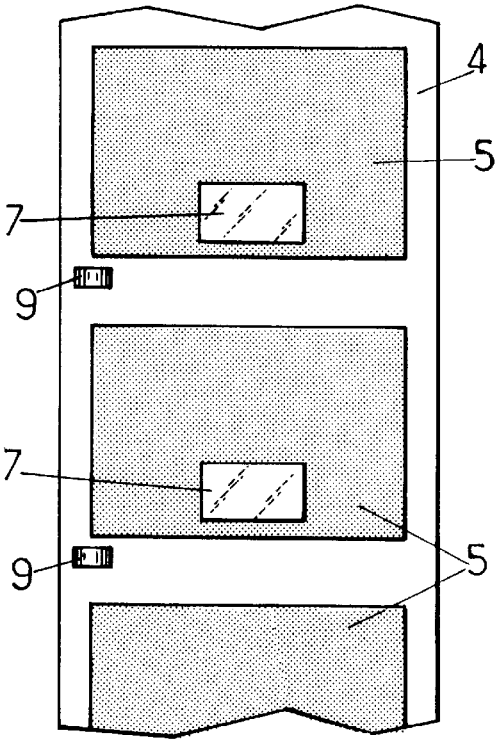
FIG. 3 is a partial view of the flexible tape containing the displays shown by the display panel of FIGS. 1 and 2.

As may be seen in FIG. 3, all the displays 5 on the tape 4 have the same format, and have a surface area greater than 2 $m^2$, for example in a range of 5 to 7 $m^2$.

In the surface of each of the displays 5, the tape 4 has an optically transparent window 7, made for example of transparent film and not printed, forming part of the tape 4. As a variant, each optically transparent window 7 could be made by a hole cut in the tape 4.

All the transparent windows 7 of the tape 4 have the same dimensions, and are situated within the corresponding image 5, occupying a surface area of for example between 5% and 70%, and preferably between 10% and 40% of the surface area of the image.

As may be seen in FIG. 2, the display panel 1 moreover comprises a video screen 8 such as a plasma or other screen placed behind the transparent window 7 of the image 5 shown to the public, which displays successive images, and particularly video sequences, corresponding to the display 5 being shown. As a variant, the video screen 8 may, if the need arises, be replaced by a small format display system capable of displaying several successive small format displays in the transparent window 7, for each display 5 shown in the aperture 3 of the display panel.

In order to ensure that the images displayed by the screen correspond to the display 5 being shown by the display panel, the display panel preferably comprises means of locating and identifying the display being shown. These means may consist for example, for each display 5, of bar codes 9 or other identification codes (see FIG. 3), these codes being read by a decoder 10 placed inside the case 2 (FIG. 2).

To advantage as may be seen in FIG. 1, the display panel 1 also broadcasts sounds (musical and/or spoken) corresponding to the images displayed by the screen 8 by means of loud speakers 11.

The operation of the display panel 1 is completely automatic and preferably operates by following:

a predetermined display sequence of the displays 5, and for each display 5 a predetermined display sequence of the images or video sequences on the screen 8.

Moreover, the display panel 1 may possibly comprise in addition an interface making the operation of the said panel interactive. This interface may consist for example of a keyboard 12 linked if the need arises to a small screen 13, the keyboard 12 and the screen 13 being integrated for example in the display panel stand 2*a*.

As a variant, the interface might also consist of a system of vocal control.

In addition, it should be noted that the interface 12, 13 may, if the need arises, also be used to enable the public to choose, at least to a certain extent, the display 5 shown by the display panel.

Finally, the display panel may, if the need arises, be adapted to make the screen 8 show different images from among the images corresponding to each display 5 according to the time of day.

Figure 4:
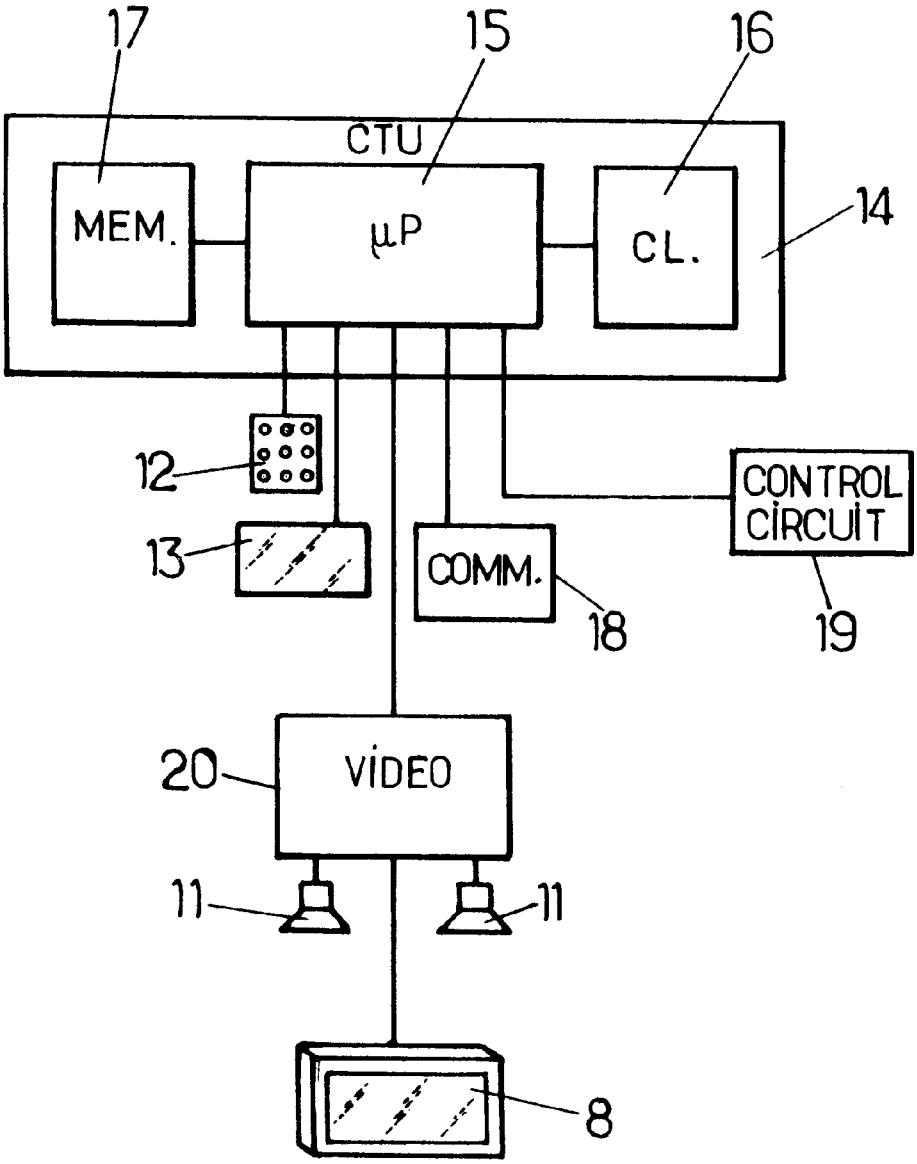
FIG. 4 is a block diagram of the control circuit corresponding to the display panel shown in FIGS. 1 and 2.

As a non restricted example, FIG. 4 shows an example of a block diagram of the control circuit of the display panel 1, the said circuit includes:

a central electronic unit 14 including, for example, a microprocessor or microcontroller 15 connected to or incorporating a clock 16 and a memory 17, a communication interface 18 which is connected to the microprocessor 15 and which makes it possible to programme the operation of the display panel, particularly during replacement of the tape 4 containing the displays 5, in order to store in the memory 17 the chronological sequence of the displays 5, the correspondence between the displays 5 and the images or video sequences shown by the screen 8, and the chronological display sequence of the images or video sequences corresponding to each display 5.

the bar code reader 10 or other decoder linked to the microprocessor 15, possibly, the keyboard 12 and the screen 13 (or other interface means) connected to the microprocessor 15, a control circuit 19 of one or more motors of the driving mechanism 6, this control circuit being linked to the microprocessor 15, a video tape 20 or similar, also linked to the microprocessor 15, this video tape being itself linked to the loud speakers 11 and to the video screen 8, the said video tape including a magnetic tape on which images or video sequences to be shown on the screen 8 are recorded.

We claim:

1. A display panel comprising:

several displays of identical format and each having a surface area of at least 2 $m^2$, at least one display surface visible to the public and enabling each display to be shown, and an automatic display changing device adapted to show the displays in succession to the public through the display surface, wherein each display comprises, in its surface, an optically transparent window having a surface area of between 5% and 70% of the surface area of the display, wherein the display panel includes at least one image display device which includes a reserve of several images for each display of the display panel and which is adapted to show said images in the window of each display at least some of said images related to each display being different from the images related to the other displays of the display panel, and wherein the display panel moreover comprises control means for successively displaying in the window of each display the images corresponding to said display by means of the image display device.

2. A display panel according to claim 1, in which the surface area of the window is between 10% and 40% of the surface area of the display.

3. A display panel according to claim 1, in which the windows are substantially identical and situated substantially identically in the several displays.

4. A display panel according to claim 1, in which the image display device includes a screen situated to correspond with the window of each display when the display is shown through the display surface, the reserve images of the image display device including at least one animated sequence corresponding to a particular display, and the control means being adapted to display the animated sequence on the screen while said particular display is shown.

5. A display panel according to claim 4, in which the reserve images of the image display device include several animated sequences for each display, the control means being adapted to display these animated sequences on the screen while the corresponding display is shown.

6. A display panel according to claim 1, in which the control means include a clock and a memory in which are stored a chronological sequence of the displays, a correspondence between the displays and the reserve images, and a chronological sequence of the reserve images corresponding to each display, said control means thus being adapted to present different images from among the images corresponding to each display according to the time of day.

7. A display panel according to claim 1, in which the control means are connected to an interface enabling the public to choose the reserve images shown by the image display device from among the reserve images corresponding to the display shown on the display surface, the control means being adapted to then show these images by means of the image display device.

8. A display panel according to claim 7, in which the interface also enables the public to choose the display shown on the display surface, the control means being adapted to then show said display on the display surface by means of the display changing device.

9. A display panel according to claim 1, in which the displays are made up of successive portions of a flexible tape, the display changing device being adapted to make siad flexible tape run past the display surface in order to selectively show one of the displays on the display surface.

10. A display panel according to claim 1, comprising sound transmission means for transmitting sounds corresponding to the images shown by the image display device.

* * * * *